US005872578A

United States Patent [19]

Takata

[11] Patent Number: 5,872,578

[45] Date of Patent: Feb. 16, 1999

[54] CAPPING DEVICE FOR INK JET HEAD IN INK JET PRINTER

[75] Inventor: Masayuki Takata, Nagoya, Japan

[73] Assignee: Brother Kogyo Kabushiki Kaisha, Nagoya, Japan

[21] Appl. No.: 689,599

[22] Filed: Aug. 12, 1996

[30] Foreign Application Priority Data

Aug. 21, 1995 [JP] Japan ..... 7-236046

[51] Int. Cl.[6] ..... B41J 2/165; B41J 2/175

[52] U.S. Cl. ..... 347/29; 347/86

[58] Field of Search ..... 347/86, 29, 22, 347/85

[56] References Cited

FOREIGN PATENT DOCUMENTS 0 674 997 A 4/1995 European Pat. Off. ..... B41J 2/175

2-125746 5/1990 Japan ..... B41J 2/165

6-191045 7/1994 Japan ..... B41J 2/165

*Primary Examiner*—Benjamin R. Fuller

*Assistant Examiner*—Thien Tran

*Attorney, Agent, or Firm*—Oliff & Berridge, PLC

[57] ABSTRACT

A capping device includes a capping member releasably attached to an ink cartridge by cooperation of holding portions formed on resilient arms of the capping member and retaining grooves formed in the ink cartridge. When the ink cartridge is attached to an ink jet head part in an ink jet printer, wedge portions of the capping member engage in slits formed in the head part, and when the ink cartridge is removed from an ink supply part of the ink jet head part, the holding portions are released from the retaining grooves by separating the ink cartridge from the ink jet head part while the wedge portions are retained in the slits. At the same time, the ink supply part is capped by a packing rubber on the cap portion of a spring arm portion of the capping member.

16 Claims, 5 Drawing Sheets

22
27
25
28
23
29
26
30
31
20A 10A
29
28
22
27
25
21
24
23
26

CAPPING DEVICE FOR INK JET HEAD IN INK JET PRINTER

BACKGROUND OF THE INVENTION

1. Field of the Invention

The present invention relates to a capping device for an ink jet head installed in an ink jet printer, the ink jet head being arranged on a carriage and having ink jet orifices at one end thereof and an ink supply part at the other end thereof. In particular, the present invention relates to a capping device through which the top of the ink supply part can be easily and certainly capped at the same time that an ink cartridge is removed from the ink jet head when an operator exchanges an empty ink cartridge with a new ink cartridge.

2. Description of Related Art

Conventionally, there are proposed various types of ink jet printers. Among such ink jet printers, there exist, in general, two types according to whether the ink jet head is fixed on the carriage or not. One is a disposable type in which both the ink jet head and the ink cartridge are exchangeable at the same time against the carriage in case of maintenance of the ink cartridge, etc. The other is a fixed type in which the ink jet head is fixed on the carriage and only the ink cartridge is exchangeable.

In the disposable type, since both the ink jet head and the ink cartridge are simultaneously exchanged in case of maintenance of the ink cartridge, there is no need for considering problems inducing bad effects that the ink orifices of the ink jet head or the ink supply part thereof are dried due to removing of the ink cartridge from the ink jet head, thus viscosity of the ink in the ink jet head becomes high, and that fine dust is adhered to the ink orifices or the ink supply part of the ink jet head.

On the contrary, in the fixed type, since only the ink cartridge is exchanged in case of maintenance of the ink cartridge, the ink orifices of the ink jet head are exposed to the atmosphere and dried, as a result, the ink orifices are blocked by the dried ink when the ink cartridge is removed from the ink jet head. In response to this problem that the ink orifices are blocked, the ink can be dissolved by contacting a wet sponge or the like with the ink orifices while printing is not conducted. On the other hand, there occurs bad effects at the ink supply part of the ink jet head such as dust adhering or high viscosity of the ink mentioned above. In this case, the conventional ink jet printer deals with as follows. That is, the empty ink cartridge is maintained to be installed to the ink supply part of the ink jet head so that the ink supply part is not exposed to the atmosphere, when the empty ink cartridge cannot be immediately exchanged with the new ink cartridge even if the ink in the ink cartridge is fully consumed, and thereafter at the time that the empty ink cartridge can be exchanged with the new ink cartridge, the empty ink cartridge is removed from the ink supply part.

However, in case that the ink in the ink cartridge is consumed and becomes empty, it is conceivable that an operator (user) falsely removes the empty ink cartridge from the ink supply part of the ink jet head and leaves the ink jet head without immediately exchanging with the new ink cartridge. In this way, if the ink supply part of the ink jet head is left to be exposed to the atmosphere, the viscosity of the ink in the ink supply part becomes high and the dust adheres to the ink supply part. As a result, it will be probable that the ink jet head itself cannot be used thereafter.

SUMMARY OF THE INVENTION

In order to overcome the above problems, the present invention provides a capping device for an ink jet head, through which an ink supply part of the ink jet head can be easily and certainly capped at the same time that an ink cartridge is removed from the ink jet head, when the empty ink cartridge is exchanged with the new ink cartridge, and therefore the ink supply part of the ink jet head can be protected for a long time.

To accomplish the above purpose, the present invention provides a capping device utilizable for an ink jet printer including an ink jet head in which ink orifices are formed at one surface and an ink supply part is formed at the other surface, and an ink cartridge which is releasably set to the ink jet head and supplies the ink to the ink jet head through the ink supply part, the capping device comprising :

a capping member having a holding part through which the ink cartridge is releasably held, an inlay part which is releasably inlaid in the ink jet head, and a cap part which is able to cap the ink supply part;

wherein the holding part is released from the ink cartridge while the inlay part is inlaid in the ink jet head when the ink cartridge is removed from the ink jet head, and the cap part caps the ink supply part.

In the capping device the capping member is held to the ink cartridge by the holding part and when the ink cartridge is set to the ink jet head the inlay part is inlaid in the ink jet head. In this state, the ink is supplied for the ink jet head through the ink supply part from the ink cartridge and printing operation of characters, etc. is conducted. Further, when the ink is consumed by the printing operation and the ink cartridge becomes empty, the empty ink cartridge is exchanged with a new ink cartridge filled with the ink. At that time, the empty ink cartridge is first removed from the ink jet head. When the ink cartridge is removed, the ink cartridge is released from the holding part of the capping member while the inlay part of the capping member is inlaid in the ink jet head, and at the same time the cap part caps the ink supply part of the ink jet head. In this way, since the ink supply part is capped by the cap part as soon as the ink cartridge is removed from the ink jet head, the ink supply part can be easily and certainly capped before the new ink cartridge is set to the ink jet head. As a result, it can prevent the dust from adhering to the ink supply part, thus the ink jet head can be protected for a long time.

The capping device is utilizable for an ink jet printer including an ink jet head in which ink orifices are formed at one surface and an ink supply part is formed at the other surface, and an ink cartridge which is releasably set to the ink jet head and supplies the ink to the ink jet head through the ink supply part, the capping device comprising :

a capping member having a cap part which is able to cap the ink supply part and a resilient arm part which presses the cap part so as to cap the ink supply part ;

wherein the cap part is contacted with one surface of the ink cartridge against a pressing force by the resilient arm part in a state that the capping member is mounted to the ink cartridge before the ink cartridge is set to the ink jet head through the ink supply part, and the cap part caps the ink supply part according to the pressing force by the resilient arm part when the ink cartridge is removed from the ink jet head.

In the capping device the ink is supplied with the ink jet head through the ink supply part from the ink cartridge while the ink cartridge is set to the ink jet head and printing operation of characters, etc. is conducted. In case that the ink of the ink cartridge is consumed by the printing operation and the ink cartridge becomes empty, the empty ink cartridge is exchanged with the new ink cartridge. In this case, the empty ink cartridge is first removed from the ink jet head. When the ink cartridge is removed, the cap part which is contacted with one surface of the ink cartridge caps the ink supply part of the ink jet head according to the pressing force by the resilient arms part. Therefore, the ink supply part can be easily and certainly capped by the cap part before the new ink cartridge is set to the ink jet head. As a result, it can prevent the dust from adhering to the ink supply part, thus the ink jet head can be protected for a long time.

Further, the capping device provides a capping device utilizable for an ink jet printer including an ink jet head in which ink orifices are formed at one surface and an ink supply part is formed at the other surface, and an ink cartridge which is releasably set to the ink jet head and supplies the ink to the ink jet head through the ink supply part, the capping device comprising :

a capping member releasably held to the ink cartridge, the capping member having an inlay part which is releasably inlaid in the ink jet head and a cap part which is able to cap the ink supply part ;

wherein the cap member is left on the ink jet head based on that the inlay part is inlaid in the ink jet head when the ink cartridge is removed from the ink jet head, and the cap part caps the ink supply part.

In the capping device of claim, the ink cartridge is set to the ink jet head with the capping member mounted to the ink cartridge. When the ink cartridge is exchanged only the ink cartridge is removed from the ink jet head, and on the other hand, the capping member is left on the ink jet head based on that the inlay part is inlaid in the ink jet head, and further the cap part caps the ink supply part of the ink jet head. Thereby, before the new ink cartridge is set to the ink jet head, the ink supply part can be easily and certainly capped. As a result, it can prevent the dust from adhering to the ink supply part, thus the ink jet head can be protected for a long time.

The above and further objects and novel features of the invention will more fully appear from the following detailed description when the same is read in connection with the accompanying drawings. It is to be expressly understood, however, that the drawings are for purpose of illustration only and not intended as a definition of the limits of the invention.

BRIEF DESCRIPTION OF THE DRAWINGS

The capping device for the ink jet head in the ink jet printer will be described with reference to the following drawings wherein.

DETAILED DESCRIPTION OF THE PREFERRED EMBODIMENTS

A detailed description of the preferred embodiment of a capping device embodying the present invention will now be given referring to the accompanying drawings.

First, a construction of an ink jet printer in which the capping device of the present invention is installed will be described according to FIG. 1.

Figure 1:
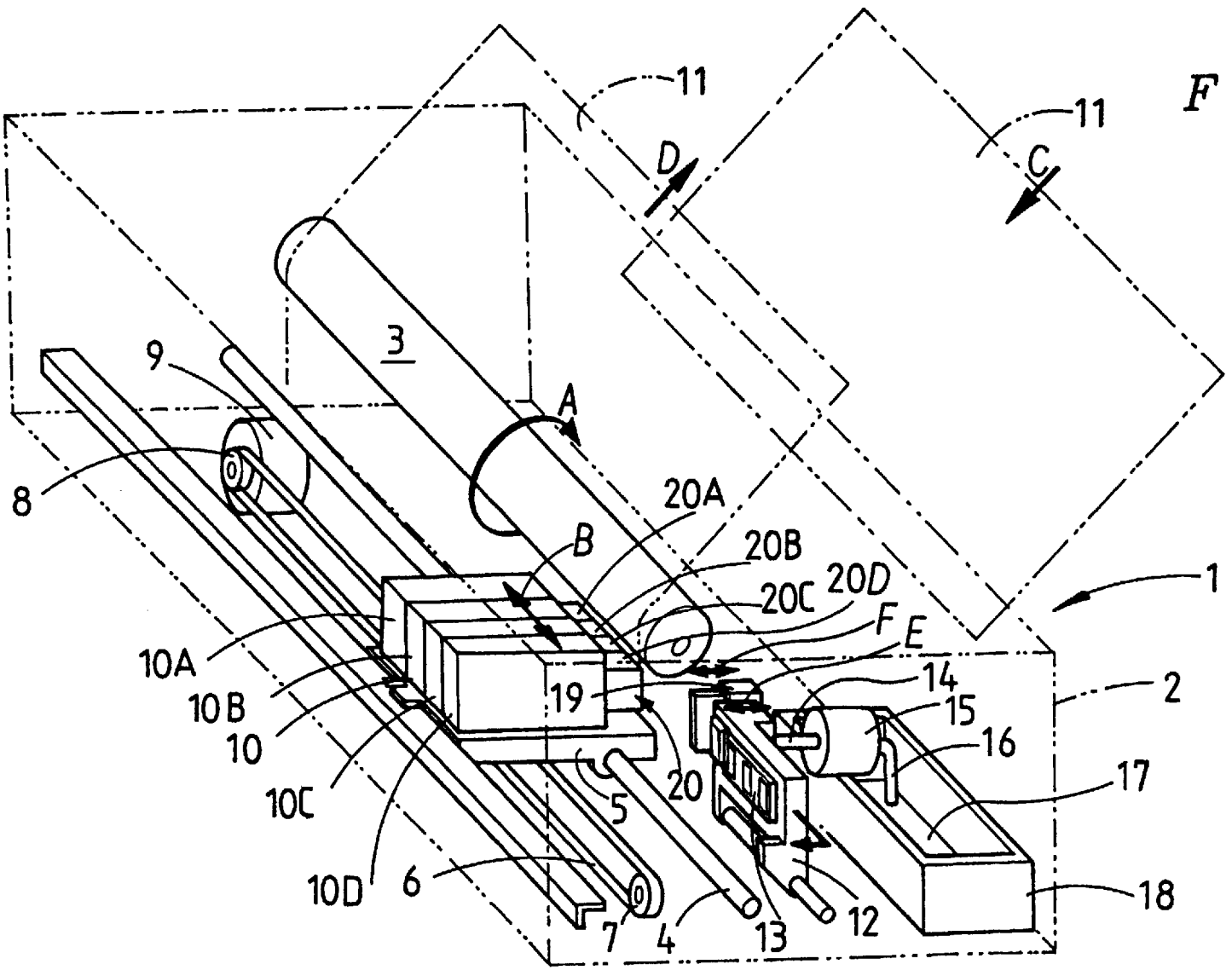
FIG. 1 is a perspective view schematically showing an ink jet printer.

In FIG. 1, a platen 3 is rotatably arranged in a direction indicated by an arrow A in a housing 2 of the ink jet printer 1 and a guide shaft 4 is arranged along with the platen 3. To the guide shaft 4 a carriage 5 is mounted so as to slidably move along with the guide shaft 4. Both ends of a belt 6 are fixed to the underside of the carriage 5 and the belt 6 is strained between an idle pulley 7 and a drive pulley 8. The drive pulley 8 is rotated by a drive motor 9 and the carriage 5 is moved along the guide shaft 4 in a direction indicated by an arrow B based on rotation of the drive pulley 8.

On the carriage 5, ink cartridges 10 are detachably mounted. Here, there exist four ink cartridges 10A, 10B, 10C and 10D. In the ink cartridge 10A, black ink is filled. Similarly, magenta ink, cyan ink and yellow ink are filled in the ink cartridge 10B, 10C and 10D, respectively. An ink jet head 20 is fixed on the carriage 5 in front of each of the ink cartridges 10A, 10B, 10C and 10D. The ink jet head 20 is divided into four head parts 20A, 20B, 20C and 20D corresponding to each of the ink cartridges 10A, 10B, 10C and 10D. Here, the ink jet head 20 is constructed into one body, and further each of the head parts 20A, 20B, 20C and 20D is independently constructed from the other, as mentioned hereinafter.

Figure 5:
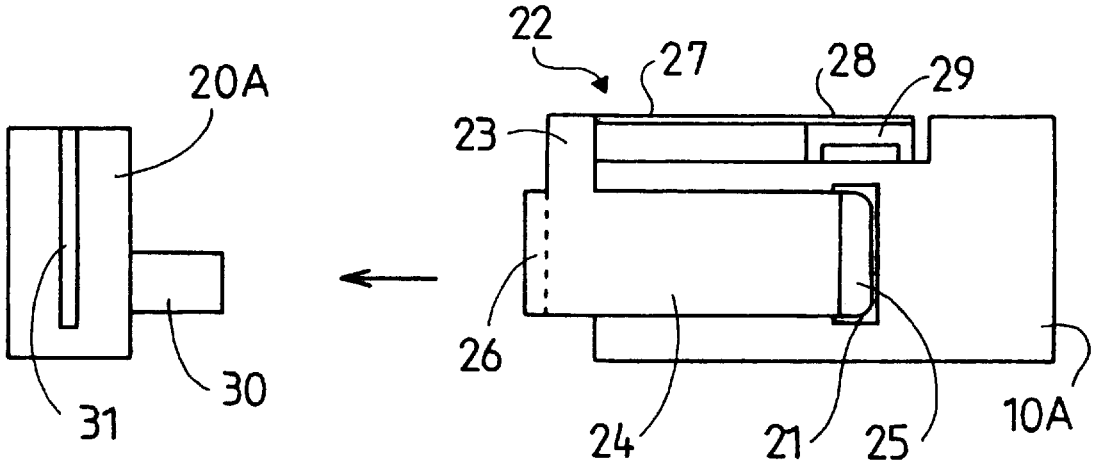
FIG. 5 is a schematic view illustrating the manner to set the new ink cartridge to the ink jet head after the empty ink cartridge is removed therefrom.

In each of the head parts 20A, 20B, 20C and 20D, a cylindrical ink supply part 30 is projected at the opposite side against the platen 3 (see FIG. 5). The ink supply part 30 is inserted in an ink supply hole formed in each of the ink cartridges 10A, 10B, 10C and 10D and supplies the ink to the head part 20A, 20B, 20C, 20D from the ink cartridge 10A, 10B, 10C, 10D. In each of the head parts 20A, 20B, 20C and 20D, an ink passage (not shown) is formed therein, further both a nozzle and an ink orifice (not shown) are formed at the side opposite to the platen 3 corresponding to each of passages.

In FIG. 1, a print sheet 11 is inserted into the housing 2 in a direction indicated by an arrow C from the rear part of the housing 2, forwarded in a direction indicated by an arrow D through the rotating platen 3, and thereafter is discharged from the housing 2 of the ink jet printer 1. When the print sheet 11 is forwarded to the platen 3, the ink is ejected from the ink orifices of the ink jet head 20 onto the print sheet 11 while moving the carriage 5, thereby printing data is desirably printed on the print sheet 11.

In FIG. 1, at a non-printing position (home position) located at the right side of the platen 3, a cap 12 is positioned and has a cap rubber 13 arranged thereon which is contacted with the ink orifices of the ink jet head 20. The cap 12 is arranged so as to be movable in a direction indicated by an arrow E against the ink jet head 20 and is moved closely to the ink jet head 20 by a moving mechanism (not shown), thereby the cap rubber 13 is contacted with the ink orifices of the ink jet head 20. Further, a connecting tube 14 is connected to the cap 12 and a suction pump 15 is connected to the connecting tube 14, as shown in FIG. 1. Further, a discharge tube 16 is connected to the suction pump 15 and the discharge tube 16 faces to an ink discharging tank 18 in which an ink absorbing member 17 is positioned. At the non-printing position, a deformable wiper blade 19 is arranged between the right side of the platen 3 and the cap 12. The wiper blade 19 is arranged so as to be able to move in a direction indicated by an arrow F. The wiper blade 19 is normally retracted to a position where it is not contacted with the ink jet head 20 and is forwarded by a motor (not shown) to a position where it is contacted with the moving ink jet head 20 when wiping is conducted.

Next, a construction of an exchange ink cartridge will be described hereinafter according to FIG. 2. The exchange ink cartridge is exchanged with the empty ink cartridges 10A, 10B, 10C, 10D when the ink in the ink cartridges 10A, 10B, 10C, 10D is consumed by the printing operation and the ink cartridges 10A, 10B, 10C, 10D become empty.

Here, the exchange ink cartridge has the same construction as each of the ink cartridges 10A, 10B, 10C, 10D and each ink cartridge 10A, 10B, 10C, 10D, is independently set to and removed from each of the head parts 20A, 20B, 20C, 20D, respectively. Therefore, description of the exchange ink cartridge will be done according to a representative example that the ink cartridge 10A filled with black ink is set to and removed from the head part 20A of the ink jet head 20.

Figure 2:
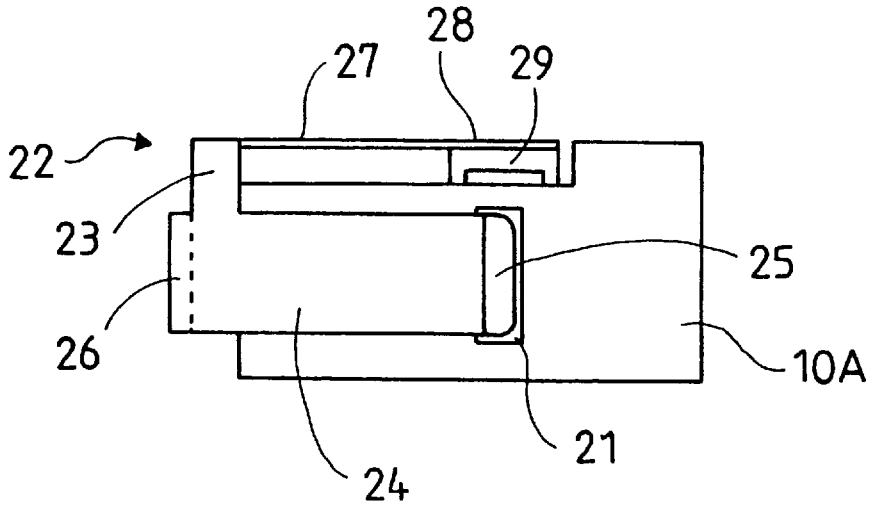
FIG. 2 is a side view of the ink cartridge.

In FIG. 2, retaining grooves 21 are formed on outer surfaces of a pair of side walls opposing each other in the ink cartridge 10A. Only one retaining groove 21 formed on one of side walls is shown in FIG. 2. Through these retaining grooves 21, a capping member 22 (mentioned later) is held to the ink cartridge 10A.

Figure 3:
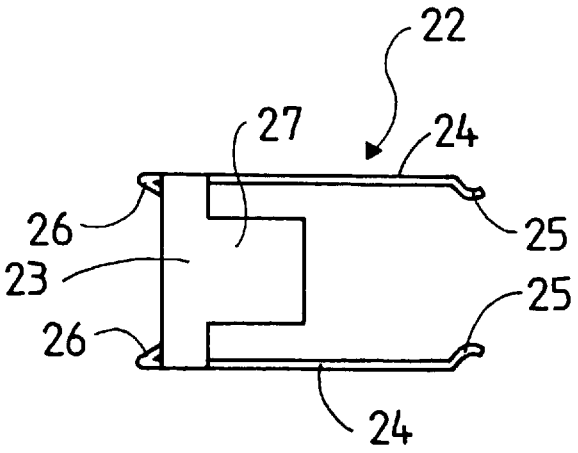
FIG. 3 is a plan view of the capping device.
Figure 4:
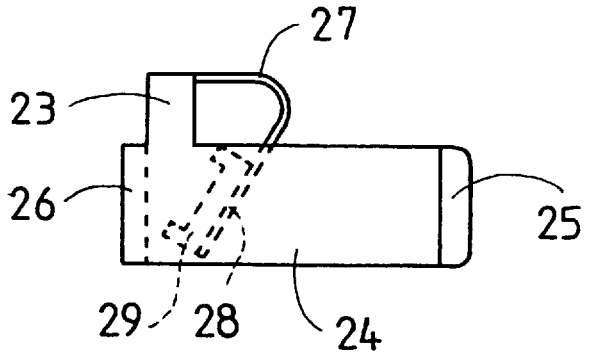
FIG. 4 is a side view of the capping device.

Here, a construction of the capping member 22 will be described according to FIGS. 3 and 4. In FIGS. 3 and 4, the capping member 22 has a connection part 23 which is projected upward so as to have a rectangular shape and a pair of resilient arms 24 extend parallel from both lower edges of the connection part 23. At one end of each resilient arm 24 (the right end in FIG. 3), a holding portion 25 which is folded inwardly and has a circular arc shape is formed as shown in FIG. 3. At the other end of each resilient arm 24 (the left end in FIG. 3), a wedge portion 26 which is folded so as to have a wedge shape is formed.

Holding portions 25 are held in the retaining grooves 21 of the ink cartridge 10A by the resilient force occurring in the resilient arms 24, and the wedge portions 26 are put in vertical slits 31 (mentioned below) formed on both sides of the head part 20A in the ink jet head 20. At that time, the fulcrums of the resilient arms 24 when resiliently deformed (bent) exist near the connection part 23 and the positions of the holding portions 25 are distant from the fulcrums. Therefore, in the direction that the ink cartridge 10A is set to and removed from the head part 20A, holding force by which the holding portions 25 are held in the retaining grooves 21 is comparatively weak. On the other hand, since the wedge portions 26 exist near the fulcrums and thus are only slightly affected by the resilient force of the resilient arms 24, the wedge portions 26 are put in the slits 31 with a holding force stronger than the holding force of the holding portions 25 in the same direction mentioned above, and further the wedge portions 26 are not easily removed from the slits 31 based on the wedge shape after they are put in the slits 31.

Between the resilient arms 24, a spring arm portion 27 is extended from approximately a center position of the connection part 23 in the same direction of the holding portions 25. At a top of the spring arm portion 27, a cap portion 28 is formed into one body. On the cap portion 28, a packing rubber 29 is adhered. Here, the spring arm portion 27 is in a bent state as shown in FIG. 4 in the case that the capping member 22 is not retained to the ink cartridge 10A.

As explained above, based on the construction of the capping member 22, the capping member 22 is retained to the ink cartridge 10A as shown in FIG. 2 since the holding portions 25 formed on the resilient arms 24 are held in the retaining grooves 21 formed on the side walls of the ink cartridge 10A by the resilient force of the resilient arms 24. At that time, the spring arm portion 27 is in an extended state against the spring force thereof as shown in FIG. 2 since the packing rubber 29 adhered on the cap portion 28 is contacted with the upper wall of the ink cartridge 10A.

Further to the above, now will be described according to FIGS. 5 to 8 a series of operations where the ink cartridge 10A is set to the head part 20A of the ink jet head 20 and the ink in the ink cartridge 10A is consumed, thereafter the empty ink cartridge 10A is exchanged with a new ink cartridge 10A in which the black ink is filled. Here, at the time that the above series of operations are started, the empty ink cartridge 10A without the ink is already removed from the head part 20A.

Figure 6:
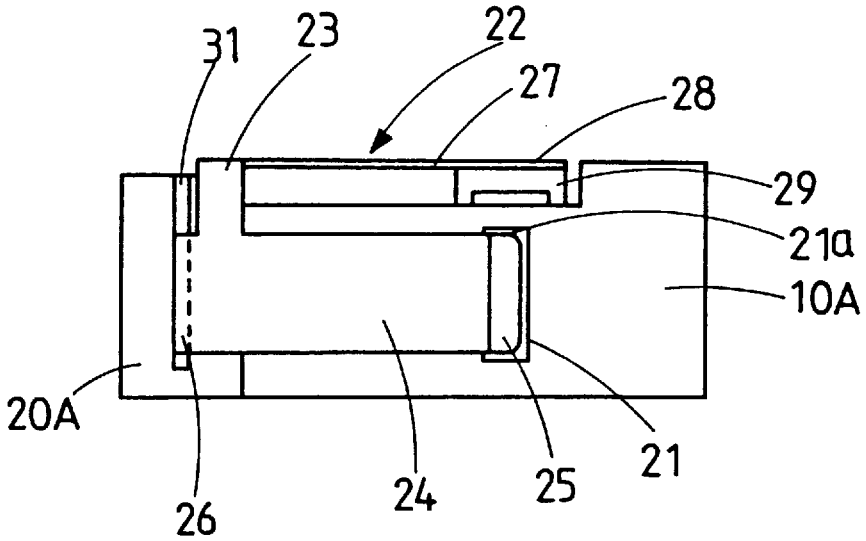
FIG. 6 is a schematic view showing a state where the new ink cartridge is set to the ink jet head.

First, when the new ink cartridge 10A filled with the ink is set to the head part 20A, the ink cartridge 10A is moved closely to the ink supply part 30 in a direction coincident with the center axis of the ink supply part 30, that is, in a direction indicated by an arrow in FIG. 5. Thereafter, the ink supply part 30 (which is formed on a side opposite to a side where the ink orifices are formed in the head part 20A) is inserted into the ink supply hole 10*a* (see FIG. 7) of the ink cartridge 10A. At this time, the wedge portions 26 formed on the resilient arms 24 in the capping member 22 are put in the slits 31 (only one slit 31 is indicated in FIG. 5) which are formed on both side walls of the head part 20A. The holding portions 25 are still held in the retaining grooves 21 of the ink cartridge 10A. This state is shown in FIG. 6.

After the ink cartridge 10A is set to the head part 20A as mentioned above, printing operation is conducted. In the meantime, when the ink in the ink cartridge 10A is consumed according to progress of the printing operation and the ink cartridge 10A becomes empty, the empty ink cartridge 10A is moved in a direction that the ink supply hole 10*a* is removed from the ink supply part 30, that is, in a direction indicated by an arrow in FIG.7. While the ink cartridge 10A is moved in this direction, the holding portions 25 are released from the retaining grooves 21 because the holding portions 25 are held in the retaining grooves with only comparative weak holding force based on the resilient force by the resilient arms 24. On the contrary, the wedge portions 26 are not easily released on the basis of the wedge shape thereof by the force along the direction indicated by the arrow after they are put in the slits 31, therefore the wedge portions 26 are retained in the slits 31. As mentioned above, by moving the ink cartridge 10A in the direction of the arrows, the ink supply part 30 is removed from the ink supply hole 10*a*, thereby only the empty ink cartridge 10A is removed from the head part 20A and capping member 22 is left on the head part 20A.

Figure 7:
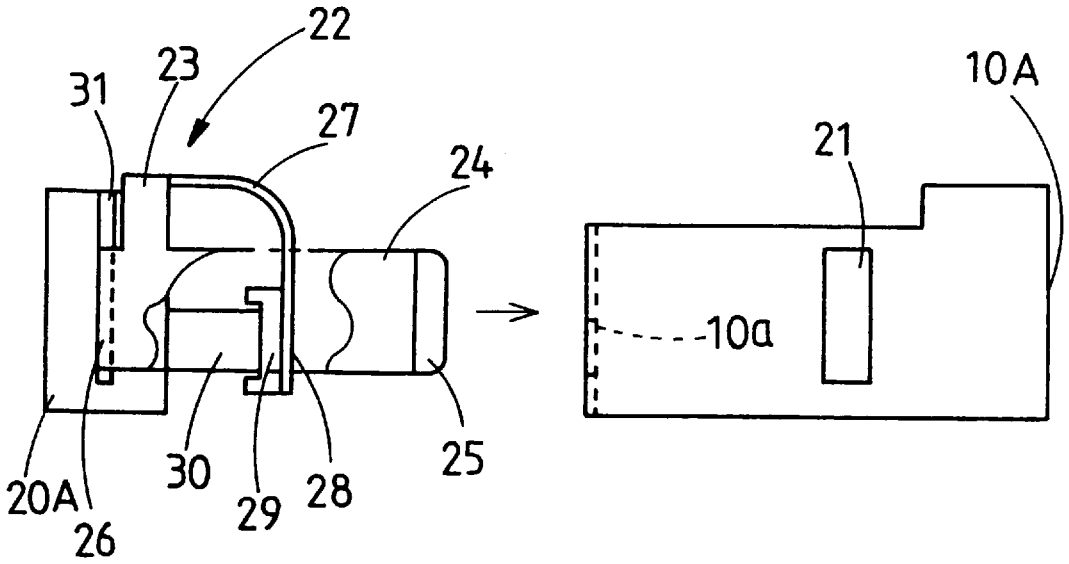
FIG. 7 is a schematic view showing a state where the empty ink cartridge is removed form the ink jet head.

At the same time that the ink cartridge 10A is removed from the head part 20A, the spring arm portion 27 which is extended on the upper wall of the ink cartridge 10A is returned to the bent state shown in FIG. 4 based on the resilient returning force thereof, thereby the packing rubber 29 adhered on the cap portion 28 of the spring arm portion 27 caps the top of the ink supply part 30. This state is shown in FIG. 7.

According to the above, the top of the ink supply part 30 is capped by the packing rubber 29 of the cap portion 28 at the same time that the ink cartridge 10A is removed from the ink supply part 30. Therefore, the top of the ink supply part 30 can be easily and certainly capped before the new ink cartridge 10A is set to the ink supply part 30. As a result, it can prevent the dust from adhering to the ink supply part 30, thus the head part 20A can be protected for a long time. At that time, the top of the ink supply part 30 is capped by the resiliently deformable packing rubber 29, thus the top of the ink supply part 30 can be capped with good hermetical ability.

Figures 8A, 8B:
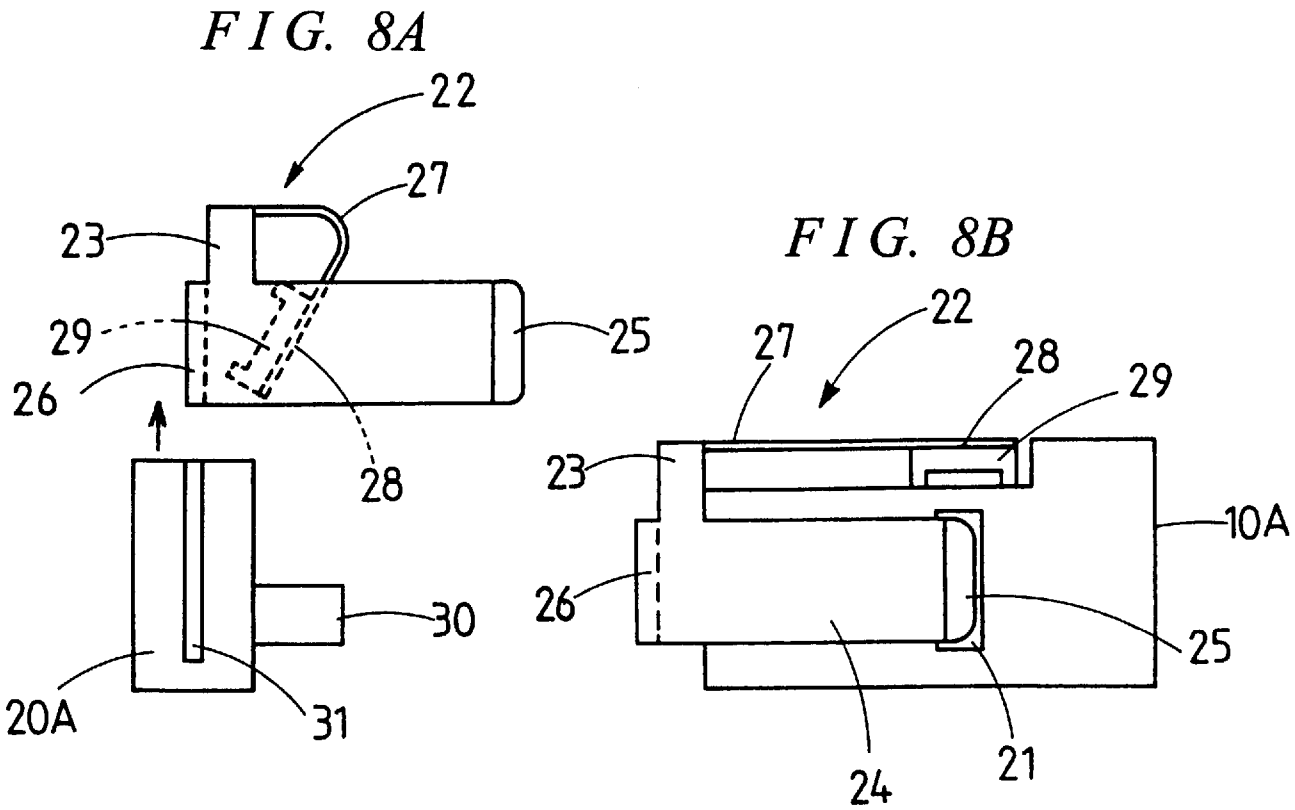
Figs. 8A and 8B are schematic views illustrating the manner to set the new ink cartridge to the ink jet head after the capping device is removed therefrom.

Next, in case that the new ink cartridge 10A is set to the head part 20A, the cap member 22 is slid upward (in a direction indicated by an arrow in FIG. 8A) along the slits 31. Here, the slits 31 are extended in a vertical direction normal to the direction along which the ink cartridge 10A is set or removed and are opened at the upper end of the head part 20A, therefore the wedge portions 26 are slid in the slits 31 in the direction of the arrows toward the upper end of the head part 20A while being held in the slits 31. Thereafter, the holding state between the wedge portions 26 and the slits 31 is released and the capping member 22 is removed from the head part 20A. This state is shown in FIG. 8A. Further, according to the same operation explained based on FIGS. 5 and 6, the new ink cartridge 10A and the cap member 22 are set to the head part 20A as shown in FIG. 8B.

Here, in the state that the ink cartridge 10A is set to the head part 20A as shown in FIG. 6, if the operator tries to remove only the capping member 22 in the above direction (upward direction), the retaining grooves 21 are shaped to be closed at the upper ends 21*a* thereof (see FIG. 6), thus the holding portions 25 are contacted with the closed upper ends 21*a*, and as a result, is prevented the capping member 22 from being removed in such upward direction. Of course, since the ink supply part 30 is inserted into the ink supply hole 10*a* of the ink cartridge 10A in the direction normal to the above direction (upward direction), the ink cartridge 10A is not also removed from the ink supply part 30 even if the capping member 22 is forcibly moved in the same direction.

As mentioned in detail, in the capping device according to the embodiment, the capping member 22 is held to the ink cartridge 10A in cooperation with the holding potions 25 formed on the resilient arms 24 in the capping member 22 and the retaining grooves 21 of the ink cartridge 10A, and when the ink cartridge 10A is set to the head part 20A, the wedge portions 26 are mutually put in the slits 31 of the head part 20A (see FIG. 6), when the ink cartridge 10A is removed from the ink supply part 30, the holding portions 25 are released from the retaining grooves 21 by moving the ink cartridge 10A from the head part 20A while retaining the wedge portions 26 in the slits 31, and at the same time the top of the ink supply part 30 is capped by the packing rubber 29 adhered on the cap portion 28 of the spring arm portion 27 based on the resilient returning force thereof (see FIG. 7). Therefore, the top of the ink supply part 30 is capped by the packing rubber 29 on the cap portion 28 as soon as the ink cartridge 10A is removed from the ink supply part 30, thus the top of the ink supply part 30 can be easily and certainly capped by the packing rubber 29. As a result, it can prevent dust from adhering to the ink supply part 30, thus the head part 20A can be protected for a long time. Because the top of the ink supply part 30 is capped by the resiliently deformable packing rubber 29, the top of the ink supply part 30 can be capped with good hermetical ability.

While the invention has been particularly shown and described with reference to preferred embodiments thereof, it will be understood by those skilled in the art that the foregoing and other changes in form and details can be made therein without departing from the spirit and scope of the invention.

What is claimed is:

1. A capping device for use in an ink jet printer including an ink jet head in which ink orifices are formed at one surface and an ink supply part is formed at another surface, and an ink cartridge which is releasably attached to the ink jet head and supplies ink to the ink jet head through the ink supply part, the capping device comprising:

a capping member including a holding part which releasably holds the ink cartridge, an engagement part which releasably engages the ink jet head, a body part connected to the holding part and a cap part which releasably caps the ink supply part by a resilient force of the body part, the body part resiliently connecting the holding part, the engagement part and the cap part;

the holding part being released from the ink cartridge while the engagement part is engaged with the ink jet head when the ink cartridge is removed from the ink jet head, and the cap part capping the ink supply part by the resilient force of the body part during removal of the ink cartridge from the ink jet head.

2. The capping device according to claim 1, wherein the capping member further includes a resilient arm part formed in the body part having an end at which the cap part is formed, the resilient arm part resiliently pressing the cap part so as to cap the ink supply part when the ink cartridge is removed from the ink jet head.

3. The capping device according to claim 1, wherein the holding part holds the ink cartridge with a first force and the engagement part engages the ink jet head with a second force greater than the first force.

4. The capping device according to claim 3, wherein the capping member is retained on the ink jet head when the ink cartridge is removed from the ink jet head.

5. The capping device according to claim 4, wherein the capping member is prevented from being removed in a first direction from the ink cartridge by the holding part holding the ink cartridge when the capping member is mounted to the ink cartridge and before the ink cartridge is attached to the ink jet head through the ink supply part.

6. The capping device according to claim 5, wherein the first direction is normal to a second direction along which the ink cartridge is attached to and removed from the ink jet head.

7. The capping device according to claim 6, wherein the capping member is releasable from the ink jet head in the first direction after the ink cartridge is removed from the ink jet head.

8. The capping device according to claim 6, wherein the second direction coincides with an axis direction of the ink supply part in the ink jet head.

9. The capping device according to claim 3, wherein the holding part comprises a pair of resilient arms formed in the body part, each resilient arm having an end at which a holding portion is formed, the holding portions being resiliently held in grooves formed on a pair of side walls in the ink cartridge.

10. The capping device according to claim 9, wherein the first force occurs between the holding portions and the grooves.

11. The capping device according to claim 9, wherein the holding portions each have a circular arc shape.

12. The capping device according to claim 9, wherein the engagement part comprises a pair of wedge portions each of which is formed at an end of the resilient arm opposite to the holding portions, the wedge portions being inlaid in slits formed on a pair of sides in the ink jet head.

13. The capping device according to claim 12, wherein the second force occurs between the wedge portions and the slits.

14. The capping device according to claim 2, wherein the cap portion includes a packing rubber which hermetically caps the ink supply part when the ink cartridge is removed from the ink jet head.

15. A capping device for use in an ink jet printer including an ink jet head in which ink orifices are formed at one surface and an ink supply part is formed at another surface, and an ink cartridge which is releasably attached to the ink jet head and supplies ink to the ink jet head through the ink supply part, the capping device comprising:

a capping member including a cap part which releasably caps the ink supply part, and a resilient arm part having an end at which the cap part is formed, the resilient arm part pressing the cap part by a pressing force so as to cap the ink supply part;

the cap part contacting a surface of the ink cartridge against the pressing force by the resilient arm part in a position in which the capping member is mounted to the ink cartridge before the ink cartridge is attached to the ink jet head through the ink supply part, and the cap part capping the ink supply part under the pressing force by the resilient arm part when the ink cartridge is removed from the ink jet head.

16. A capping device for use in an ink jet printer including an ink jet head in which ink orifices are formed at one surface and an ink supply part is formed at another surface, and an ink cartridge which is releasably attached to the ink jet head and supplies ink to the ink jet head through the ink supply part, the capping device comprising:

a capping member releasably attached to the ink cartridge, the capping member having an engagement part which releasably engages the ink jet head, a body part connected to the holding part and a cap part which releasably caps the ink supply part by a resilient force of the body part, the body part resiliently connecting the engagement part and the cap part;

the cap member being retained on the ink jet head by the engagement part engaging with the ink jet head when the ink cartridge is removed from the ink jet head, and the cap part capping the ink supply part by the resilient force of the body part during removal of the ink cartridge from the ink jet head.

* * * * *